US005914004A

United States Patent [19]

Kettunen et al.

[11] Patent Number: 5,914,004

[45] Date of Patent: Jun. 22, 1999

[54] METHOD OF PRODUCING PULP FOR PAPER MANUFACTURE

[75] Inventors: Jyrki Kettunen, Kirkniemi; Jukka Ranua, Lohja, both of Finland

[73] Assignee: Metsa-Serla Oy, Finland

[21] Appl. No.: 08/768,375

[22] Filed: Dec. 17, 1996

[30] Foreign Application Priority Data

Dec. 18, 1995 [FI] Finland ..... 956096

[51] Int. Cl.[6] ..... D21C 3/22

[52] U.S. Cl. ..... 162/91; 162/72; 162/74; 162/99; 162/77; 162/78; 800/200

[58] Field of Search ..... 162/91, 92, 93, 162/94, 95, 96, 98, 99, 17, 19, 23, 27, 70, 72, 73, 74, 75, 76, 77, 78; 47/58, 6, DIG. 3, DIG. 6; 800/200, 230, 240, DIG. 4–DIG. 43

[56] References Cited

U.S. PATENT DOCUMENTS

| | | | |
|---|---|---|---|
| 2,536,045 | 1/1951 | Eskridge | 162/95 X |
| 2,536,046 | 1/1951 | Eskridge | 162/95 X |
| 2,864,662 | 12/1958 | Dungler | 162/73 X |
| 3,832,278 | 8/1974 | Villavicencio | 162/80 |
| 4,087,316 | 5/1978 | Jividen et al. | 162/14 |
| 4,096,029 | 6/1978 | Mills | 162/89 |
| 4,106,979 | 8/1978 | Ruffini et al. | 162/73 |
| 4,699,691 | 10/1987 | Villavicencio | 162/19 |
| 4,718,980 | 1/1988 | Lowrie et al. | 162/78 |
| 4,740,212 | 4/1988 | Yant et al. | 8/108.1 |
| 4,801,353 | 1/1989 | Mason | 162/73 |
| 4,851,082 | 7/1989 | Mita et al. | 162/76 |
| 4,859,282 | 8/1989 | Chou et al. | 162/78 |

OTHER PUBLICATIONS

Sven A. Rydholm, "Pulping Processes", Interscience Publisher, pp. 90–99, 166–181 and 614–615, Jan. 1967.

Bonga, J.M. et al., "In Vitro Culture of Trees," *Forestry Sciences 38*, Sec. 3:12–54, Sec. 4:55–71, and Sec.5:72–125, 1992.

Ryynänen, Leena et al., "Propagation of adult curly–birch succeeds with tissue culture," *Silva Fennica 20*(2):139–147, 1986.

Shariff, Azim J. et al., "Unexpected source of phenol in the sulfur–free semichemical pulping of hardwood," *Tappi Journal* 177–183, Mar. 1989.

Alfthan, C–J. et al., "High–temperature peroxide bleaching of sulphate pulp," *Svensk Papperstidning 15*:480–482, 1997.

Dialog File 351 (Derwent World Patents Index), Abstract for SU 1581741, WPI Acc. No. 91–09267/25.

Lehto, J. et al., "Various Poplar Species as Raw Material for Paper Grade Mechanical Pulps," *International Mechanical Pulping Conference,* Jun. 12–15, 1995, Ottawa, Canada, pp. 9–21.

Dialog File 240 (Paperchem) English language abstract of Ona T. et al., "Studies on Decision of Selection Indexes for Quality Breeding of Eucalyptus Pulpwood; Within–Tree Variations and the Positions Representing the Whole–Tree Values of Lignin Content and Lignin S:G [Syringyl:Guaiacyl] Ratio of Eucalyptus camaldulensis and Eucalyptus globulus," *Japan Tappi Journal 49*(*6*):967–974, Jun. 1995.

*Primary Examiner*—Stanley S. Silverman
*Assistant Examiner*—José S. Fortuna
*Attorney, Agent, or Firm*—Sterne, Kessler, Goldstein & Fox P.L.L.C.

[57] ABSTRACT

The present invention is related to a method of producing paper pulp from a fibrous raw material. According to the invention, such pulpwood is used in which the content of phenol compounds or phenolic derivatives is clearly, advantageously at least 20% lower than the average content of such compounds in the native grade of the raw material. Advantageously, the content of parahydroxy-benzoic acid (PHBA) is determined from the pulpwood and pulpwood containing low PHBA levels is used as pulping raw material. The invention also provides a method of producing pulpwood suitable for use in the manufacture of easily bleachable paper pulp, in which method selected native specimens of pulpwood trees with an advantageously low content of phenol compounds or phenolic derivatives are produced by micropropagation, the cloned tree specimens are planted and grown to obtain pulping raw material, the pulpwood is harvested, and the pulpwood is produced into paper pulp using mechanical, chemical or chemimechanical delignification methods.

9 Claims, 4 Drawing Sheets

METHOD OF PRODUCING PULP FOR PAPER MANUFACTURE

TITLE OF THE INVENTION

The present invention relates to the production of pulp for paper manufacture.

1. Field of the Invention

The invention also concerns a method for producing pulping raw material suitable for making an easily bleachable pulp.

2. Background of the Invention

In Finland, the pulp in paper manufacture is chiefly made from pine, spruce and birch. The availability of coniferous pulpwood is limited by the slow regeneration of coniferous wood forests, because the span from the planting to the harvesting usually takes approx. 40–50 years. Deciduous wood species such as birch and aspen grow faster but their qualities are not as advantageous in terms of pulp production.

Aspen has been planted during the 1950's to 1970's in Finland chiefly on the initiative of the Foundation for Forest Tree Breeding in Finland and the Finnish Forest Research Institute. Cloned species of aspen has been grown with a varying degree of success. Naturally, the Finnish aspen grows well in the local circumstances of Finland, and is regenerated better from root suckers than from seeds. The Foundation for Forest Tree Breeding in Finland and the Finnish Forest Research Institute crossed and breeded so-called aspen hybrids in order to improve their growth factors.

Owing to its fast growth, aspen and particularly the aspen hybrid are interesting alternatives as the pulping raw materials for paper and other cellulosic pulps. A generally adopted rule of thumb for the growth rate of aspen is one meter of height per year and one centimeter of diameter per year. This growth rate is characteristic of hybrids that have been crossed from the Finnish and the Canadian species. Finland has about 1 million hectares of field uncultivated under a subsidy agreement, which could be returned to profitable use through reforestation. As the growth potential of aspen is approx. 10–12 $m^3$/sq. decameter (hectare), a 10 $Mm^3$ annual growth increase is possible to achieve. It must be noted that the intended and/or decided investments of the industry result in a significant boost of wood consumption from the current level, which means that active deeds in pulpwood production are justified in a longer perspective, in spite of the widespread belief of sufficient supply of pulpwood from current woods. Even as low a portion as one tenth of uncultivated fields means a noticeable increase in wood production (that is, 1 $Mm^3$/year).

According to an established opinion in the breeding of aspen, moles and moose have been considered to favour aspen as their nutrition. This belief has popped up in the years following the planting of aspen, after a major part of the plantations have failed. A more recent opinion, however, has considered the coincidence of the peak years of mole damage with the years of planting to be a random occurrence. In practice, the damages on aspens caused by moles have not been larger than those caused on birch, for instance. In reality, the retarded growth of the pure Canadian species in Finland can be attributed to damages caused by insects and other factors.

So far, investigation into the breeding of aspen has been curtailed to the above-described botanical aspect and visual look of growing trees. A relatively small portion of studies has been directed into the mechanical or fiber/web properties of aspen pulp. For instance, the specific weight (density) of the different species is not known for the aspen plantations mentioned above.

BRIEF SUMMARY OF THE INVENTION

In conjunction with the present invention, aspen and in particular aspen hybrid have been investigated with a focus on the usability these species as pulpwood in the preparation of mechanical, chemical and chemimechanical pulp. Herein, an unexpected discovery has been made that significant inherent variations occur in the content of phenol compounds and phenolic derivatives in different clones of aspen hybrid. Corresponding variations have recently been found also in other wood species and even in annual plants. Such variations in the pulping raw material can be utilized in conjunction with a pulping process. In this respect, the following inferences could be made from the pilot-scale pulping of aspen hybrid and the analyses of pulp thus obtained:

A significant difference exists between the bleachability of pulps (either mechanical or chemical) of high and low phenolic derivative content in favour of low phenolic derivative content.

The fiber qualities of pulp with a low phenolic derivative content are not worse than those of a high phenolic derivative content, possibly even better.

BRIEF DESCRIPTION OF THE DRAWINGS

FIG. 1 depicts the overall content of phenolic derivatives (parahydroxybenzoic acid (PHBA), vanillin, phenol and syringyl aldehyde) measured from a total of 133 trunks of aspen clones.

FIG. 2 depicts the overall content of parahydroxybenzoic acid content measured from a total of 133 trunks of aspen clones.

FIG. 3 depicts the overall contents of phenolic derivatives in another set of 166 trunks of aspen clones, the concentrations being determined by a modified analysis method (cf. Example 4).

DETAILED DESCRIPTION OF THE PREFERRED EMBODIMENTS

The invention is based on the concept of producing a cellulosic or paper pulp from such a pulping raw material in which the content of phenol compounds or phenolic derivatives is substantially lower than the average content of such compounds in the pulping raw material natively growing in the woods. By using such a low-phenolic-content pulpwood, an easily bleachable pulp is achieved.

By selecting such tree specimens of the pulpwood species in which the content of phenol compounds or phenolic derivatives is clearly below the average content of said compounds in the natively growing specimens, a pulping raw material suitable for use in the production of pulp is achieved. However, since the daily consumption of pulpwood in a single pulp mill can be thousands of tons of wood, such a straightforward solution is impractical. According to the invention, a method suitable for industrial application has been developed based on micropropagation of desired tree species.

The method according to the invention for producing pulpwood comprises the steps of determining the content of phenol compounds or phenolic derivatives in native specimens of pulpwood trees, selecting specimens with a content of phenol compounds or phenolic derivatives lower than that of the average in said population of native trees by at least 20%, producing said selected specimens of pulpwood trees into identical tree clones by micropropagation, and planting and growing said cloned tree specimens to obtain pulping raw material.

The invention provides significant benefits. Thence, the brightness of pulp with the same consumption of bleaching chemicals may be improved significantly by choosing a pulping raw material from the group of lignocellulosic materials of low content of phenol compounds or phenolic derivatives. Alternatively, the invention makes it possible to keep the target value of pulp brightness unchanged while simultaneously reducing the bleaching process load and the environmental load caused by the bleaching process.

Figure 1:
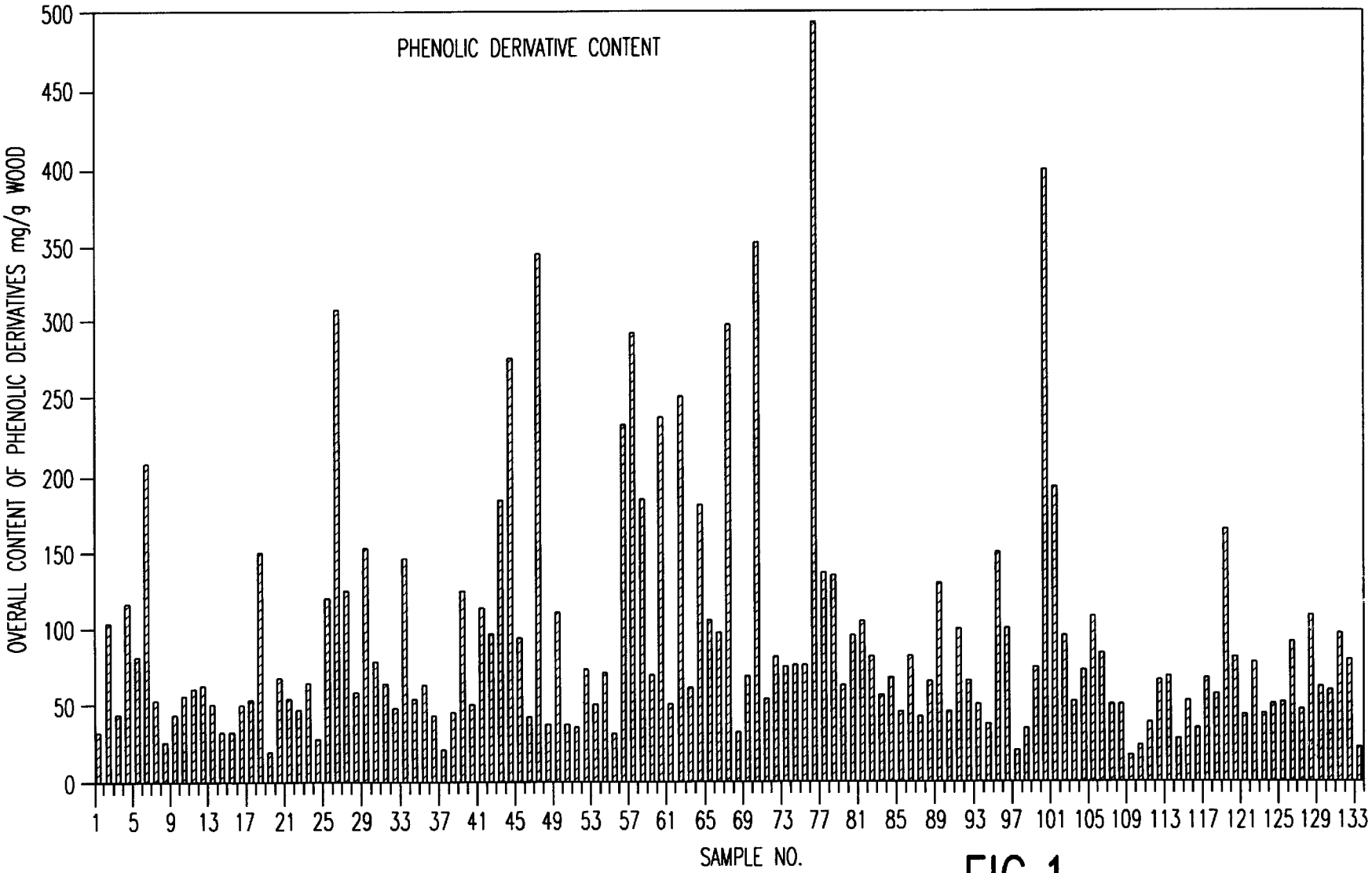
FIG. 1.
Figure 2:
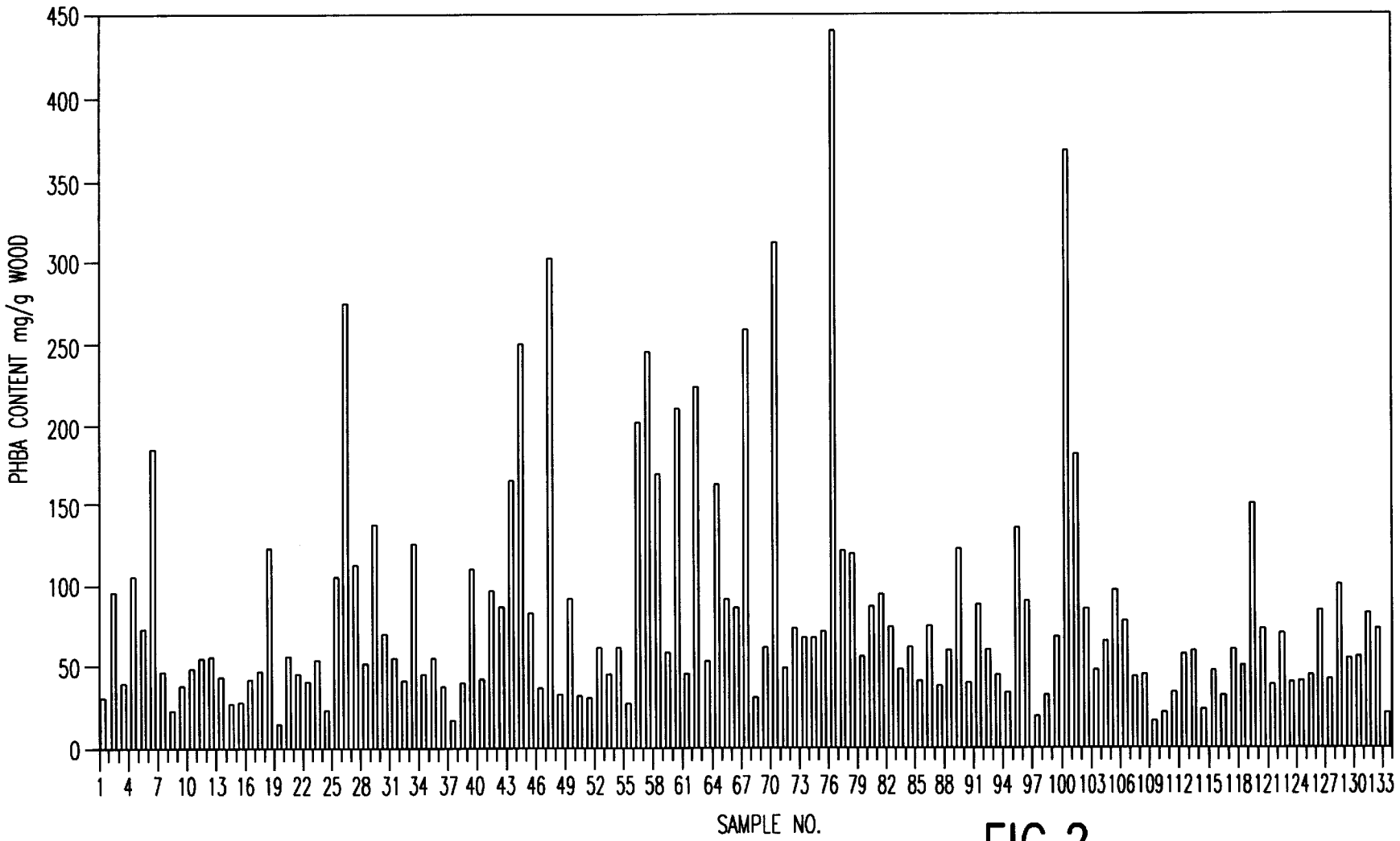
FIG. 2.
Figure 3A:
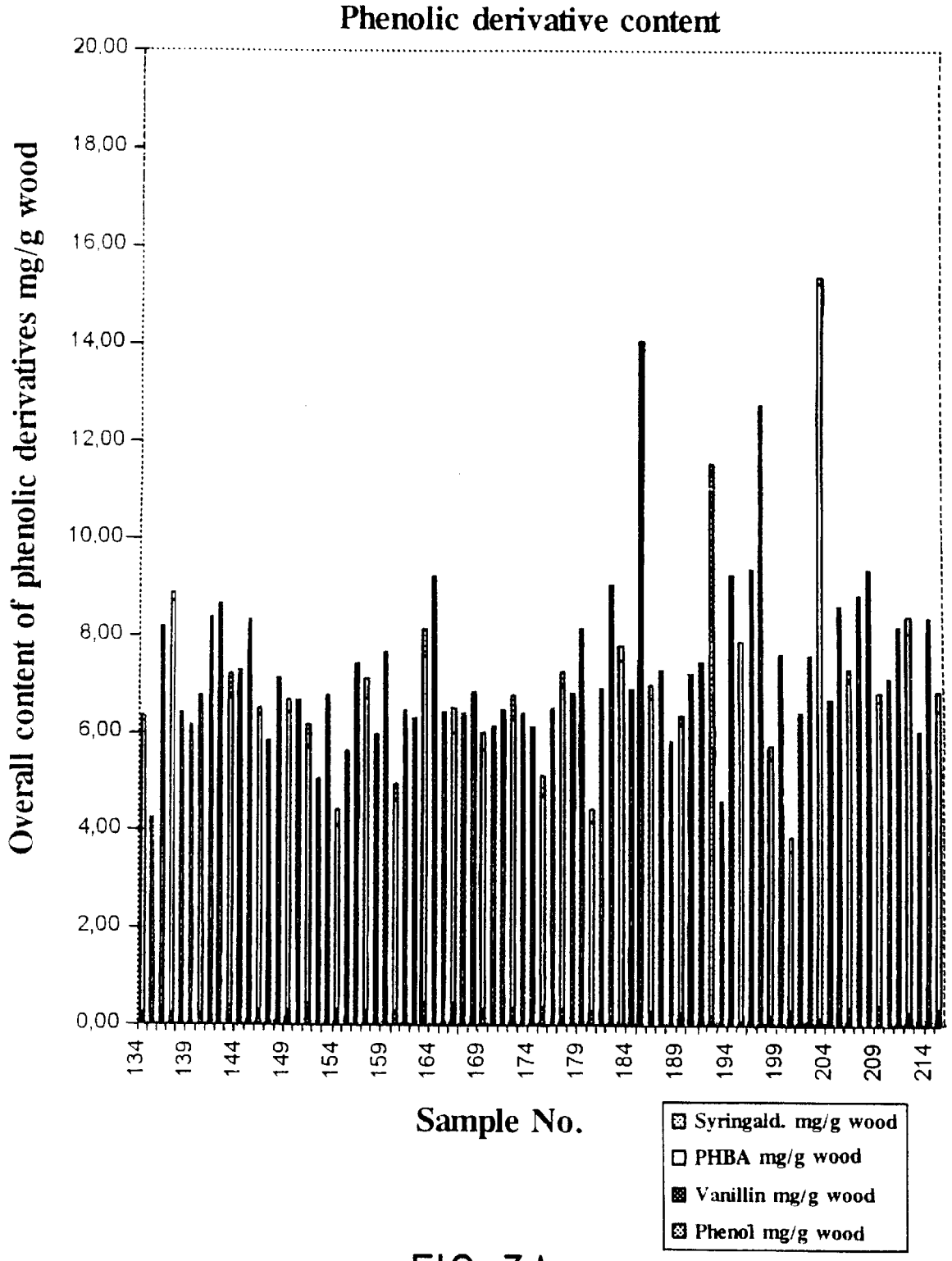
FIG. 3.
Figure 3B:
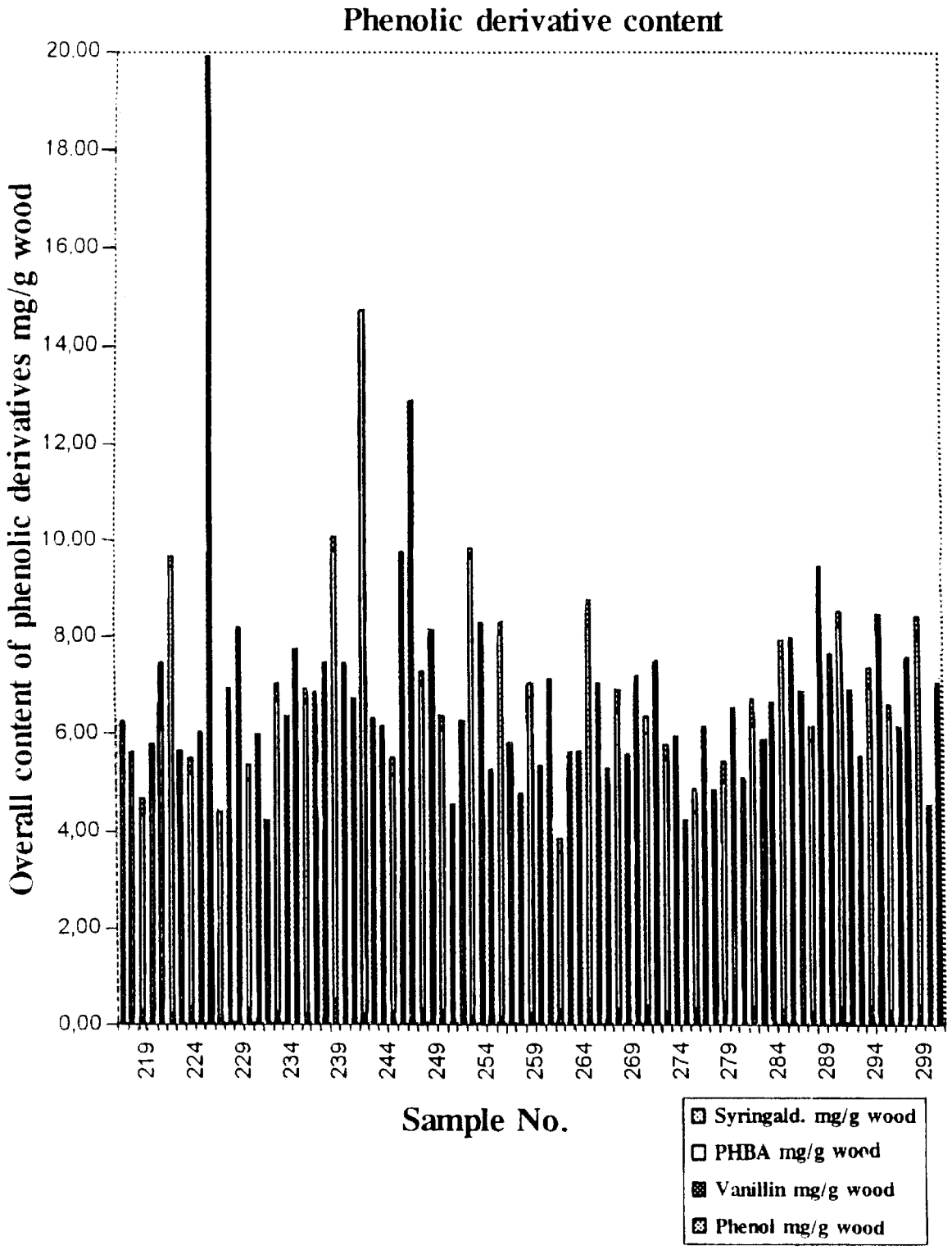

In the following, the invention will be examined in more detail with the help of an elucidating description and exemplifying embodiments. In the attached drawings (FIG. 1 and FIG. 2) are plotted the overall contents (FIG. 1) of phenolic derivatives (parahydroxybenzoic acid, vanillin, phenol and syringyl aldehyde) measured from a total of 133 trunks of aspen clones and their parahydroxybenzoic acid contents (FIG. 2), respectively. FIG. 3 depicts the overall contents of phenolic derivatives in another set of 166 trunks of aspen clones, the concentrations being determined by a modified analysis method (cf. Example 4).

As is evident from the diagrams, based on the analysis method of Example 1, the average phenolic derivative content in 133 trunks of aspen clones is over 90 mg/g, while the PHBA content is approx. 83 mg/g on the average. The invention advantageously uses such pulpwood as a raw material in which the content of phenol compounds or phenolic derivatives is at least 10%, or more advantageously at least 20% smaller than the average content of said compounds in a native pulpwood raw material. Of the phenolic derivatives crucial to the invention, particularly significant are parahydroxybenzoic acid, vanillin and syringyl aldehyde. According to a preferred embodiment of the invention, from the pulpwood tree is determined its parahydroxybenzoic acid (PHBA) content, whereafter the pulping raw material is selected from the group of trees having a parahydroxybenzoic acid content not higher than approx. 75 mg, advantageously maximally approx. 50 mg per g dry wood (whereby the advantageous maximum contents of overall phenolic derivatives are approx. 80 mg and approx. 60 mg per g dry wood, respectively). The PHBA content has been found to represent with a sufficient accuracy the overall content of phenol compounds and phenolic derivatives in the wood, which is also evident from a comparison of FIGS. 1 and 2. Thence, the determination of the content of this compound alone is sufficient according to the invention.

According to a preferred embodiment, the pulping raw material is selected from the group of such trunks of tree clones in which the PHBA contents are in the range 0–40 mg/g dry wood. As compared with tree clones having their PHBA contents in the range 200–500 mg/g dry wood, an improvement of a few (2–3) brightness units prior to bleaching are obtained in groundwood pulp, while in chemical pulps the improvement is greater than 2.5 brightness units. At a brightness level of about 80, such a difference is noticeable already under a visual comparison.

The determination of phenol compounds and phenolic derivatives in plant material is described, e.g., in the paper "Unexpected source of phenol in the sulfur-free semichemical pulping of hardwood", Shariff, A. J. et al, Tappi Journal, March 1989, pp. 177–183. Thence, the extraction of PHBA, phenol, vanillin and syringyl aldehyde from wood samples is possible by means of, e.g., alkaline hydrolysis. After silylation, the contents of PHBA, vanillin and syringyl aldehyde are most appropriately determined by gas chromatography. Phenolic residues in turn can be determined after acetylation by flame ionization detection combined with gas chromatography.

As noted above, both wood and annual/perennial plants can be used as pulping raw material. The variations in the content of phenol compounds and phenolic derivatives found in conjunction with the present invention occur in all of these plants. However, particularly advantageously the pulping raw material for cellulosic pulp production is selected from the group of aspen, spruce, poplar, maple, willow, alder, cottonwood, birch, pine, eucalyptus (or mixed tropical wood), straw, reed and bagasse, wherein trees belonging to the Populus family such as poplar, trembling aspen (*P. tremula*), *Populus tremuloides* and particularly the aspen hybrid (F1 clones) are by virtue of the fast growth especially favourable.

The fiber thus produced may be fiberized or delignified by means of any conventional process including mechanical, chemical or chemimechanical pulping. The cooking process can be continuous or a batch process. In particular, the pulping raw material according to the invention is suitable for the production of sulfate pulp, sulfite pulp, organosolv pulp, milox pulp, semichemical pulp, as well as the TMP, CTMP, refiner groundwood and pressure-ground or ground types of pulps. Particularly advantageously, the pulp is made chemically or mechanically.

The concept according to the invention can be applied particularly advantageously to pulps made in the sulfate process or other alkali-based cooking processes. Herein, the term "sulfate process" refers to a cooking method in which the principal cooking chemicals comprise sodium sulfide and sodium hydroxide. As examples of other alkali-based cooking methods, extended cooking processes may be mentioned herein based on continuing a conventional sulfate cooking until the kappa value of the pulp falls below approx. 20. These method typically include oxygen treatment. As examples of extended cooking methods, herein may be mentioned the extended batch cook (with anthraquinone addition), the EMCC (extended modified continuous cook), the batch cook, the Super-batch/$O_2$ cook, the MCC/$O_2$ cook and the continuous cook with $O_2$ addition.

The invention also provides for the production of sulfite pulp which is cooked under either acid or neutral, or even alkaline conditions, possibly in the presence of AQ-type or boron-containing additives. The fiber material can also be pulped in sulfite/sulfide cooking processes.

A cellulosic pulp may also be produced using organic cooking chemicals such as aliphatic alcohols or carboxylic acids. Aliphatic alcohols are used in, e.g., the so-called Organosolv process. Carboxylic acids and hydrogen peroxide can be combined into mixtures whose active component in the cooking process is an organic peracid. A particularly advantageous process is the so-called Milox process. This process includes three steps, whereby the first step comprises first treating the lignocellulosic pulping raw material with formic acid and then with a small amount of hydrogen peroxide at 60–80° C. In the second step of the process, the main delignification is carried out by elevating the cooking temperature to 90–100° C., followed by treatment of the brown pulp in the third step with a fresh solution of formic acid and hydrogen peroxide. The formic acid concentration is higher than 80% in all steps. The cooking time typically is 1–3 hours.

In addition to chips or replacing them, annual plants may advantageously be used as pulping raw material of the Milox process, and formic acid can be replaced by acetic acid, whereby the active component of the cooking liquor is peracetic acid.

After cooking, the pulp made from the pulping raw material according to the invention can be bleached in a conventional manner using a chlorine-free process and/or using chlorine-containing bleaching chemicals. Today, the bleaching processes of cellulosic pulps are widely based on the use of chlorine-gas-free bleaching chemicals such as oxygen, hydrogen peroxide and ozone, as well as chlorine dioxide. Prior to any of these bleaching steps, the pulps being bleached are subjected to chelating in order to remove heavy metals that catalyze reactions which can deteriorate pulp quality. In cellulosic pulps, heavy metals are principally bound with the carboxylic acid groups.

As examples of suitable (chlorine-gas-free) bleaching sequences, the following may be mentioned:

(Q)—O—Z—P (Q)—O—$P_n$

O—(Q)—Z—P

O—(Q)—$P_n$

O—D—E—D

O—X—$P_n$, where

O=oxygen treatment

P=peroxide treatment $P_n$=multiple sequential peroxide treatment steps

E=alkaline stage

Q=treatment with complexing agent

D=chlorine dioxide treatment

X=enzyme treatment.

Alkali treatment steps can be carried out between the bleaching steps using an oxygen chemical. For enhanced bleaching, conventional enzymes such as cellulases, hemicellulases and ligninases may be used, too.

As mentioned above, the investigations performed in conjunction with the invention have resulted in a method capable of providing a lignocellulosic pulping raw material of low content of phenol compounds or phenolic derivatives which is suitable for producing a cellulosic or paper pulp. The method comprises the following steps:

- the content of phenol compounds or phenolic derivatives are determined from native specimens of pulpwood trees,
- specimens with a content of phenol compounds or phenolic derivatives lower than that of the average in said population of native trees by at least 20% are selected,
- the selected specimens of pulpwood trees (using, e.g., their twigs or buds) are produced into identical tree clones by micropropagation, and
- the cloned specimens of trees are planted and grown to obtain pulping raw material.

After the pulping raw material has attained a desirable volume increase, the wood is harvested and used in the production of paper pulp with the help of mechanical, chemical or chemimechanical delignification methods. When desired, the pulp can then be bleached as described above. After the harvesting of pulpwood, the roots of "plus tree" stumps are allowed to form root suckers for the regeneration of the preferred quality pulpwood resources. The above-mentioned steps can be repeated several times if required.

Micropropagation of trees can be based on using axillary buds, adventitious buds or somatic embryogenesis. Thence, the practice of the cloning process comprises determination of the content of phenol compounds or phenolic derivatives from the twigs and/or buds of the cloned trees, after which samples are taken from the test objects and deep-freezed as necessary. The micropropagation of the samples can be performed using the methods described in, e.g., the following publications:

Bonga, J. M and von Aderkas, P.: In vitro culture of trees. Kluwer Academic Publishers, Dordrecht, 1992. (Particularly items: Media preparation, pp. 12–54; Collection, sterilization, excision and culture, pp. 55–71; Clonal propagation, pp. 72–125).

Haapala, T. and Niskanen, A.-M.: Pohjoisten puuvartisten kasvien mikrolisäys (title in English: Micropropagation of Nordic woody plants). Valtion painatuskeskus, Helsinki, 1992. 93 pp.

Ryynänen, L. and Ryynänen, M.: Propagation of adult curly-birch succeeds with tissue culture. Silva Fennica 20:1986, pp. 139–147.

In practice, the tree clone register must contain at least approx. 50–100 clone samples to achieve so large a clonal base in which the statistical probability for avoiding susceptibility of cloned trees to damage by insects and other factors is sufficiently high.

Next, the invention is elucidated with the help of the following examples:

EXAMPLE 1

Identification of Aspen Specimens Possessing Advantageous Contents of Phenol Compounds and Phenolic Derivatives From aspen clones planted by The Foundation for Forest Tree Breeding in Finland and Metla (The Finnish Forest Research Institute) in Vihti and Loppi, tree specimens of particularly favourable growth were selected on the basis of visual examination in spring 1995 for closer examination. From the analysis of samples taken with a core barrel bore taken from 133 different clones it was found that the contents of phenol compounds or phenolic derivatives in the aspen clone samples varied widely (cf. annexed diagram). Even between visually similar aspen specimens growing adjacent to each other, the difference in the phenolic derivative content of wood could be significant (from 5-fold to 10-fold, maximally 20-fold in the analyzed material).

As can be seen from the annexed diagram, the phenolic derivative content (as PHBA) was greater than 100 mg/g dry wood in approx. 25% of the aspen clones. In about 30% of the tree clones, the phenolic derivative content was less than 40 mg/g dry wood, thus correspondingly being below the average. At the very extremes, the tree clones were found to include specimens with a phenolic derivative content of less than 20 mg/g dry wood, as well as also specimens with a phenolic derivative content of greater than 300 mg/g dry wood.

It should be noted that the phenolic derivative concentrations were calculated from data obtained from wet wood samples assuming a dry substance content of 50%.

On the basis of the analyzed wood material, aspens of both high and low phenolic derivative content were selected pairwise from the same location of the plantation for closer examination. As representative specimens of high phenolic derivative content, clones 4 and 44 were selected having a phenolic derivative content of 120 and 280 mg/g dry wood, respectively, and clones 8 and 46 with a phenolic derivative content of 20 and 40 mg/g dry wood, respectively, were selected to represent aspen clones of low phenolic derivative content. Samples 4 and 8 were taken from Loppi, while samples 44 and 46 were taken from Vihti.

These aspen clones were felled, cut to logs, debarked and transported to a pilot-scale pressure grinder or chipper, and therefrom to pilot-scale cooking into cellulosic pulp.

EXAMPLE 2

Production and Bleaching of Pressure-Ground Wood (PGW)

From the trunks of the aspens of different PHBA contents described in Example 1 above were processed into pressure-ground wood samples in a pilot-scale grinder plant of Valmet Pulp Technology Research Center.

The groundwood samples were bleached with peroxide and their brightness values were determined in Oy Keskuslaboratorio (The Finnish Pulp and Paper Research Institute) as follows:

The groundwood furnish samples with an initial consistency of about 1% were densified into a small-mesh wire bag (mesh size 41 $\mu$m) at the washing filter and centrifuged lightly to approx. 20% solids content. The peroxide bleachings were carried out with the help of small-scale equipment (using a 40 g batch of groundwood) in the triple-layer plastic bag immersed in a water bath. The bleaching temperature was 65° C., reaction time 90 min and groundwood consistency 12.5%. The amount of peroxide used was 0.8%.

After bleaching, the pH of the groundwood furnish was measured and a sample of the waste solution was taken in order to determine the peroxide residue. The furnish was diluted to 3% and its pH was adjusted to pH 5 with aqueous solution of $SO_2$. For brightness measurement, a Büchner sheet was made (using ion-exchanger purified water, 1% consistency at pH 5, a couple of drops of EDTA, filter paper, 300 kPa compression pressure of test sheet and air drying in dark between support rings). The rest of the bleached groundwood furnish was taken to circulating-water sheet formation and testing.

Unbleached and bleached PGW aspen furnishes were made into 52 g/m$^2$ circulating-water test sheets which were dried on a polished plate (SCAN-M5:75), and their optical properties (SCAN-P3:93 and SCAN-P8:93) and paper quality properties (SCAN-M8:76) were determined.

Table 1 below shows the analysis results of pressure groundwood furnish made from high- and low-PHBA pulping raw material, respectively, wherein samples taken from the same growth location are compared with each other.

TABLE 1

Analysis results of pressure groundwood furnish

| | High PHBA | Low PHBA | High PHBA | Low PHBA |
|---|---|---|---|---|
| Clone no. | 4 | 8 | 44 | 46 |
| Brightness after grinding | 69.4 | 71.3 | 68.6 | 72.9 |
| Brightness after peroxide bleaching | 80.2 | 81.4 | 80.8 | 82.0 |

As can be seen from the table above, the brightness values of groundwood furnish samples made from low-PHBA tree clones are after grinding about 2 or 3 units higher than the brightness values of groundwood furnish samples made from high-PHBA tree clones. After peroxide bleaching, the difference became slightly smaller, but still remained by about 1.5 units higher in favour of the low-PHBA tree clones.

EXAMPLE 3

Production and Bleaching of Sulfate Pulp

Tree clones 44 and 46 were used for making sulfate pulp in a 15-liter sulfate cooker under laboratory conditions (Oy Keskuslaboratorio) using identical cooking conditions. The cooking temperature was raised in 30 min from 20° C. to 80° C., after which it was further elevated to 165° C. in 120 min. The cook time was 45 min. Chemical dosing was 3.545 mol NaOH/kg pulp and 0.955 mol $Na_2S$/kg pulp. The liquid/wood ratio was 3.5 and cook sulfidity was 35%.

The pulps were bleached after cooking in a single-step peroxide bleaching process under the following conditions: consistency 10%, temperature 90° C., time 60 min and peroxide dosing 3.0%. The complexing agent used was DTPA (with 0.2% dosing).

The test results are shown in Table 2 below:

TABLE 2

Results of 15-liter cellulosic pulp cooking

| | High PHBA | Low PHBA |
|---|---|---|
| Yield | 57.6 | 57.7 |
| Kappa value of cook | 20.0 | 17.9 |
| Brightness after 2-hour peroxide bleaching | 76.9 | 80.4 |
| Brightness after 3-hour peroxide bleaching | 79.5 | 82.1 |

As can be seen from Table 2 above, the brightness of peroxide-bleached sulfate pulp with the same yield is more than 3 units higher when low-PHBA-content pulpwood is selected for pulping. Furthermore, such a selected pulpwood is easier to cook as is evident from the kappa value after cooking. The kappa value is measure of lignin content in the pulpwood, and thus, the low-PHBA pulpwood has a smaller lignin content.

Alternatively, as is evident from both Example 2 and Example 3, the concept according to the invention makes it possible to reduce the environmental load caused by the chemicals of the bleaching process if the target value of brightness is kept unchanged.

EXAMPLE 4

Extended Follow-Up Study of Cloned Aspen

Using a visual "plus tree" selection from the planted aspen clones studied in the above examples, aspen specimens with above-the-average growth were taken under closer examination. An analysis of core barrel samples from the group of clones 134–300 again proved that a wide variation existed in the content of phenol compound and phenolic derivatives between the different aspen specimens (cf. annexed diagram). As compared to the analysis results obtained in Example 1, the variations between the clones remains large. It must be noted, however, the improved analysis method of the present Example is so much modified that the actual values are not comparable with those of the initial study of Example 1. Therefore, the analysis results should be subjected to an interstudy comparison only. Yet, the new results confirm that the clones of low phenolic derivative content could be bleached with a smaller chemical dosing and/or to a higher brightness than the clones of higher phenolic derivative content in both mechanical and chemical pulping just in the same fashion as the pulpwoods analyzed in Example 1.

The analysis method was modified so that from a single core barrel sample it became possible to determine first the solids content and the phenolic derivatives content, after which the analysis residue by way of maceration could be analyzed for the fiber properties, including fiber length and coarseness (mass per unit length).

We claim:

1. A method of producing paper pulp having a high brightness from a fibrous raw material, comprising the steps of:

a) determining the average phenol compound or phenolic derivative content of specimens of a pulpwood species, b) selecting a specimen of part (a) having a phenol compound or phenolic derivative content which is lower than said average content of said compounds in said specimens of part (a), and c) producing said paper pulp by delignifying the fibrous raw material of the selected specimen of part (b) or a clone thereof, wherein said paper pulp that is produced has a brightness which is higher than the brightness obtained from said specimens of part (a) that have an average, or higher than average, content of phenol compounds or phenolic derivatives, when said specimens of part (a) are used to produce pulp by the same method.

2. The method according to claim 1, wherein said selected specimen of part (b) has a content of phenol compounds or phenolic derivatives which is at least 10% lower than the average content of such compounds in the specimen of part (a).

3. The method according to claim 1, wherein said selected specimen of part (b) has a content of parahydroxybenzoic acid, vanillin, syringyl aldehyde or phenol compounds is at least 20% lower than the average content of such compounds in the specimen of part (a).

4. The method according to claim 1, wherein the specimen of part (b) is selected from the group consisting of wood, annual plants and perennial plants.

5. The method according to claim 4, wherein the specimen is selected from the group consisting of aspen, spruce, poplar, maple, willow, alder, cottonwood, birch, pine, eucalyptus, straw, reed and bagasse.

6. The method according to claim 4, wherein in the specimen is aspen hybrid.

7. The method according to claim 1, wherein the selected specimen is used for producing a pulp by a process selected from the group consisting of mechanical pulping, chemical pulping and chemimechanical pulping.

8. The method according to claim 7, wherein said pulp is bleached using chlorine-free bleaching methods.

9. The method according to claim 7, wherein said pulp is bleached using chlorine-containing bleaching methods.

* * * * *